US007192028B2

(12) United States Patent
Kramer

(10) Patent No.: US 7,192,028 B2
(45) Date of Patent: Mar. 20, 2007

(54) DEVICE FOR PROCESSING PRINTED PRODUCTS SUPPLIED TO A STACKING DEVICE

(75) Inventor: Felix Kramer, Vordemwald (CH)

(73) Assignee: Grapha-Holding AG, Hergiswil (CH)

( * ) Notice: Subject to any disclaimer, the term of this patent is extended or adjusted under 35 U.S.C. 154(b) by 473 days.

(21) Appl. No.: 10/121,530

(22) Filed: Apr. 12, 2002

(65) Prior Publication Data

US 2002/0153228 A1 Oct. 24, 2002

(30) Foreign Application Priority Data

Apr. 23, 2001 (EP) ..... 01810394

(51) Int. Cl.
*B65H 29/04* (2006.01)

(52) U.S. Cl. ..... 271/306; 271/204; 271/69

(58) Field of Classification Search ..... 271/204, 271/82, 69, 306, 72
See application file for complete search history.

(56) References Cited

U.S. PATENT DOCUMENTS 4,457,656 A 7/1984 Kosina et al.
5,110,108 A * 5/1992 Muller ..... 271/69
5,226,780 A * 7/1993 Sjogren et al. ..... 414/790.4
5,931,459 A * 8/1999 Landgren ..... 271/204
6,000,695 A * 12/1999 Mack et al. ..... 271/303
6,527,268 B2 * 3/2003 Spurk ..... 271/195

FOREIGN PATENT DOCUMENTS

| | | |
|---|---|---|
| CH | 491810 | 6/1970 |
| CH | 567996 | 10/1975 |
| EP | 0153983 | 9/1985 |
| EP | 0183013 | 6/1986 |

* cited by examiner

*Primary Examiner*—Patrick Mackey
*Assistant Examiner*—Kaitlin Joerger
(74) *Attorney, Agent, or Firm*—Friedrich Kueffner

(57) ABSTRACT

In a device for processing printed products supplied to a stacking device, the printed products are picked up at a delivery of a printing machine or a printed product processing machine by a transport device and are transported in a suspended position on a transport path to a transfer device upstream of a stacking device. The stacking device is a unit detachable from the transfer device and connectable alternatingly to the transfer device connected so as to effect conveying of the printed products to the printing machine or the printed product processing machine.

13 Claims, 5 Drawing Sheets

DEVICE FOR PROCESSING PRINTED PRODUCTS SUPPLIED TO A STACKING DEVICE

BACKGROUND OF THE INVENTION

1. Field of the Invention

The invention relates to a device for processing printed products supplied to a stacking device, which are picked up at a delivery of a printing machine or a printed product processing machine by a transport device for further transport in a suspended position and are supplied via a conveying path to a transfer device arranged upstream of the stacking device. The invention also relates to a device for performing the method.

2. Description of the Related Art

In printed product processing finished printed products are produced on the printing machine by a so-called direct printing process and are subsequently supplied to a stacking device for forming stacks.

In the case of printed products which contain semi-finished products and/or inserts, the printed products (main products) which are picked up at the delivery of the printing machine are fed before stacking to an insertion machine in which the semi-finished products and/or inserts are inserted into the opened main products.

The "direct printing product", after having been picked up at the delivery of the printing machine, is picked up by a transport device, for example, a cycled transport device, and, after completing a certain conveying path, is repositioned, for transfer into a compartment wheel, in an imbricated conveying flow in which the trailing printed product rests partially, with the fold leading, on the preceding one.

The "insertion printed product" is received at the delivery of the insertion machine by a cycled transport device and is transferred in the same way as in the case of the direct printing product to a transfer device. In this connection, it happens repeatedly, in particular, in the high-performance range, that the significantly heavier insertion products, which also are to be removed in a doubled arrangement from an insertion pocket, cannot be reliably placed in an imbricated flow as a result of their weight and the considerable thickness and subsequently cause negative effects in the stacking operation.

SUMMARY OF THE INVENTION

It is an object of the present invention to provide for the insertion printed product a transfer device with which a reliable processing or a position-precise placement of the printed products is ensured by means of a uniform arrangement of the printed products and which is connectable in a conveying-effective way to a uniform stacking device.

In accordance with the present invention, this is achieved in that the stacking device is configured as a unit which can be detached from the transfer device and can be connected alternatingly to a transfer device connected in a conveying-effective way to the printing machine or the printed product processing machine. This measure provides the possibility of employing the same stacking device for the direct printing product as well as for the insertion printed product.

The device according to the invention enables a supply of the printed products, picked up at the delivery of the printing machine by the transport device, to the transfer device in the form of an imbricated flow.

As an alternative, the device according to the invention enables the supply of the printed products to the transfer device in an individualized arrangement when they are picked up at the delivery of the printed product processing machine by a transport device.

Advantageously, the transfer device at the end of transfer path is configured as a partial stacking device which is connected so as to be synchronized with the cycle time of the stacking device which, for a stack change or during stacking in the stacking device, interrupts the flow to the latter or receives the continuously supplied printed products so that the supply must not be interrupted.

Preferably, for the transfer of suspendedly supplied printed products to the stacking device a conveying drum is provided at the upstream end of the transfer device which in the approach area of the suspendedly supplied printed products rotates synchronously and moves in the same direction as the printed products, wherein the conveying drum has at its circumference pivotable grippers for gripping the suspended ends of the printed products and placing the printed products at the end of the transfer path in a substantially horizontal position on the partial stacking device by opening the grippers. In this way, a continuous conveying flow can be realized and the printed products are subjected to a gentle processing.

Expediently, the grippers have at least one gripper arm which in the approach area or gripping area of the suspended printed products can control the grippers into a closing position securing the printed products and in the transfer area can move the grippers into an open position. In combination with the above described features this provides a steady or continuously proceeding transfer of the printed products from the transport device, for example, a cycled transport device to the conveying drum or its grippers. Of course, an embodiment according to the invention for the closing or opening process provides the possibility of actuating both gripper arms.

It has proven to be beneficial when the transfer path of the printed products transported by the conveying drum ending in the transfer area extends about an angle of approximately 180° so that the printed products can be received in a vertically suspended position by the opened grippers and can be deposited in a substantially horizontal position wherein receiving by the conveying drum is realized in that the printed products move into the open grippers located in the vicinity of the gripping area.

For transferring the printed products to the partial stacking device arranged above the stacking device, it is advantageous when the individual grippers in the transfer area of the printed products are caused by a control device to perform a frozen or paused movement or a movement which delays the circulation speed in order to be able to position the printed products by means of the grippers at a reduced conveying speed.

In this connection it is suggested that the grippers are fastened on a pivotably controlled control lever arm of a double lever which is connected to a control path. In the transfer area of the printed products the double lever is controlled to move in a direction counter to the circulating direction.

Preferably, the lever arm is aligned at least in the transfer area of a gripper approximately radially to the axis of rotation of the conveying drum and connected with an angled control arm which is actuated by the control path so that a simple constructive embodiment results.

For the purpose of pivotability the lever arms of the grippers are arranged at a uniform spacing on a graduated circle arranged concentrically relative to the axis of rotation of the conveying drum.

The control path of the double lever has a control section extending about the transfer area of the printed products which continuously approaches the axis of rotation of the conveying drum so that an inconspicuous lever movement results.

The partial stacking device has correlated therewith a stripper plate as a placement assist device which penetrates the circulating path of the printed products and which pushes the printed products in the transfer area out of the grippers.

For actuating the gripper arms of a gripper, control levers are provided which are connected to a control curve and are fastened, respectively, on the lever arms of the double levers or are connected therewith in a control-effective way.

For the purpose of uniform pick-up of the printed products at the conveying drum, the grippers of a gripper pair is arranged oppositely on the lateral ends of the conveying drum, respectively.

In this connection it is advantageous when the circulating paths of the grippers in the receiving area are arranged or distributed at a lateral spacing to the transport device.

In the following, the invention will be explained in connection with one embodiment with the aid of the drawing, to which reference is being had with respect to all details not explained with particular detail in the description.

DESCRIPTION OF THE PREFERRED EMBODIMENTS

Figure 1:
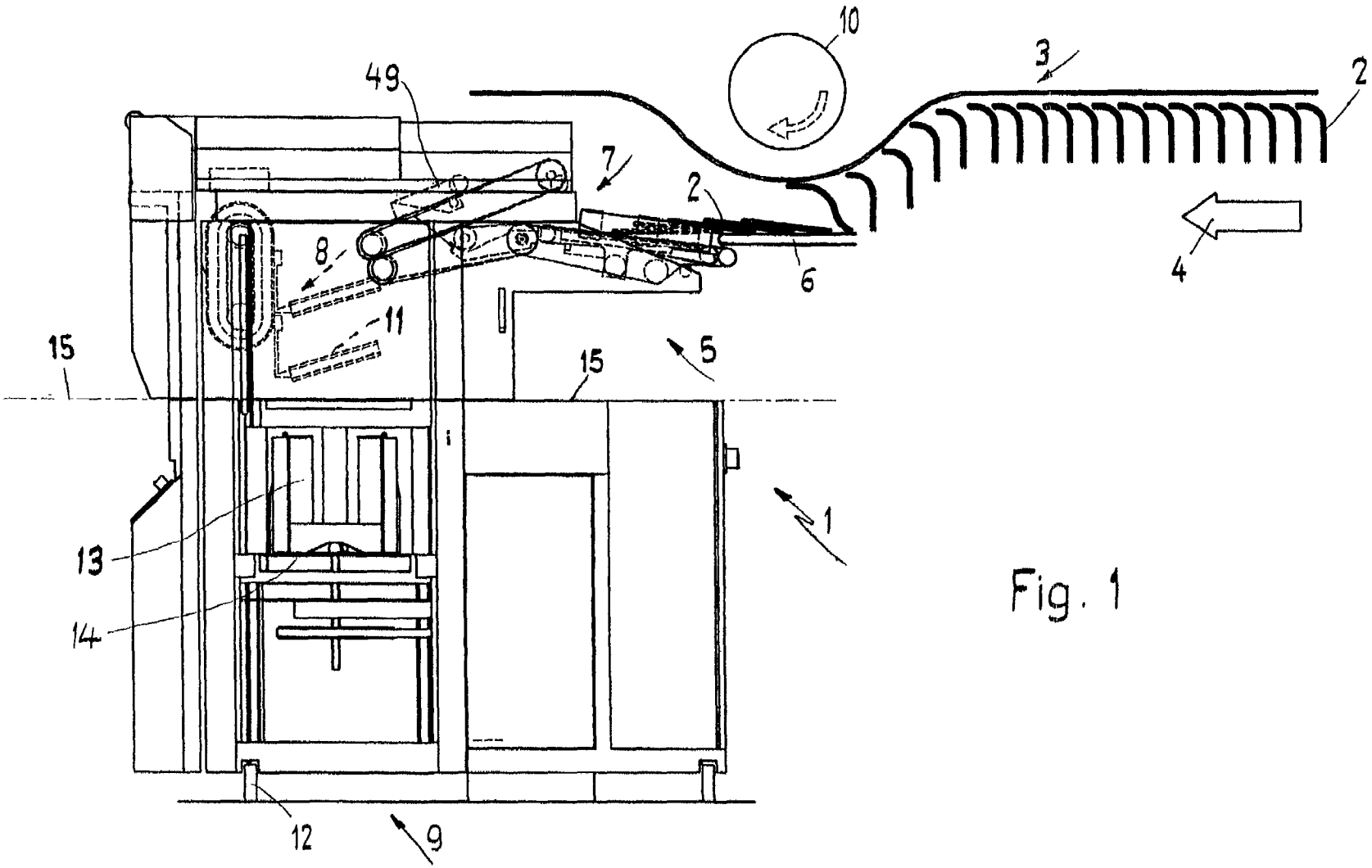
FIG. 1 shows a device according to the invention for processing printed products removed from the delivery of a printing machine.

FIG. 1 shows schematically a device 1 for processing printed products 2 removed from a delivery of a printing machine, for example, an offset rotary printing machine (not illustrated), which are supplied by a transport device 3 to a transfer device 5. In this connection, the printed products 2 are freely suspended from clamps 50 (shown in FIG. 5) of the transport device 3 and are moved with their open lower end onto a conveying member 6, for example, a circulating belt. As soon as the printed products 2 have reached the conveying member 6, the clamps of the transport device 3 will open. Accordingly, the printed products 2 drop in a roof tile-like formation—the trailing one onto the leading one—and form in this way an imbricated flow in which the folding edge of the printed products 2 extend transversely to the conveying direction according to arrow 4 so that the folding edge is leading. By means of a further conveying belt arrangement 7 the printed products 2 are supplied to a partial stacking device 8 where the printed products 2 are received in partial stacks and are dropped onto a stacking device 9 arranged underneath. In the illustrated embodiment, the partial stacking device 8 comprises circulating shelves 11 for receiving the partial stacks which shelves rotate about two vertically spaced-apart centers; this is disclosed, for example, in Swiss patent application 491 810 or U.S. Pat. No. 5,226,780. Loading of the stacking device 9 with partial stacks is interrupted when the stack produced in the stacking device 9 is to be removed. During the removal period, the shelves of the partial stacking device 8 are further supplied with printed products 2 by the continuously supplied imbricated flow. The stacking process is automatically performed by means of a control. Additionally, it should be mentioned that a removal device 10 is arranged in the area of the conveying member 6 above the transport device 3 with which the printed products 2 can be removed.

The transfer device 5 is supported on a separate frame on the floor or is suspended from the ceiling of the building.

The stacking device 9 can be moved on wheels 12 and is configured to be moved to the transfer device 5. It is comprised of a frame in which a drop shaft 13 surrounding a turntable 14 in the upward direction is arranged, and means for pushing the stack out of the stacking device, as disclosed, for example, in European patent document 0 153 983. The upper end of the drop shaft 13 which is adjustable with respect to the different formats of the printed products 2 to be received forms with the lower edge of the transfer device 5 an intersecting plane 15 so that the stacking device 9 of the transfer device 5 can be easily advanced or removed.

Figure 2:
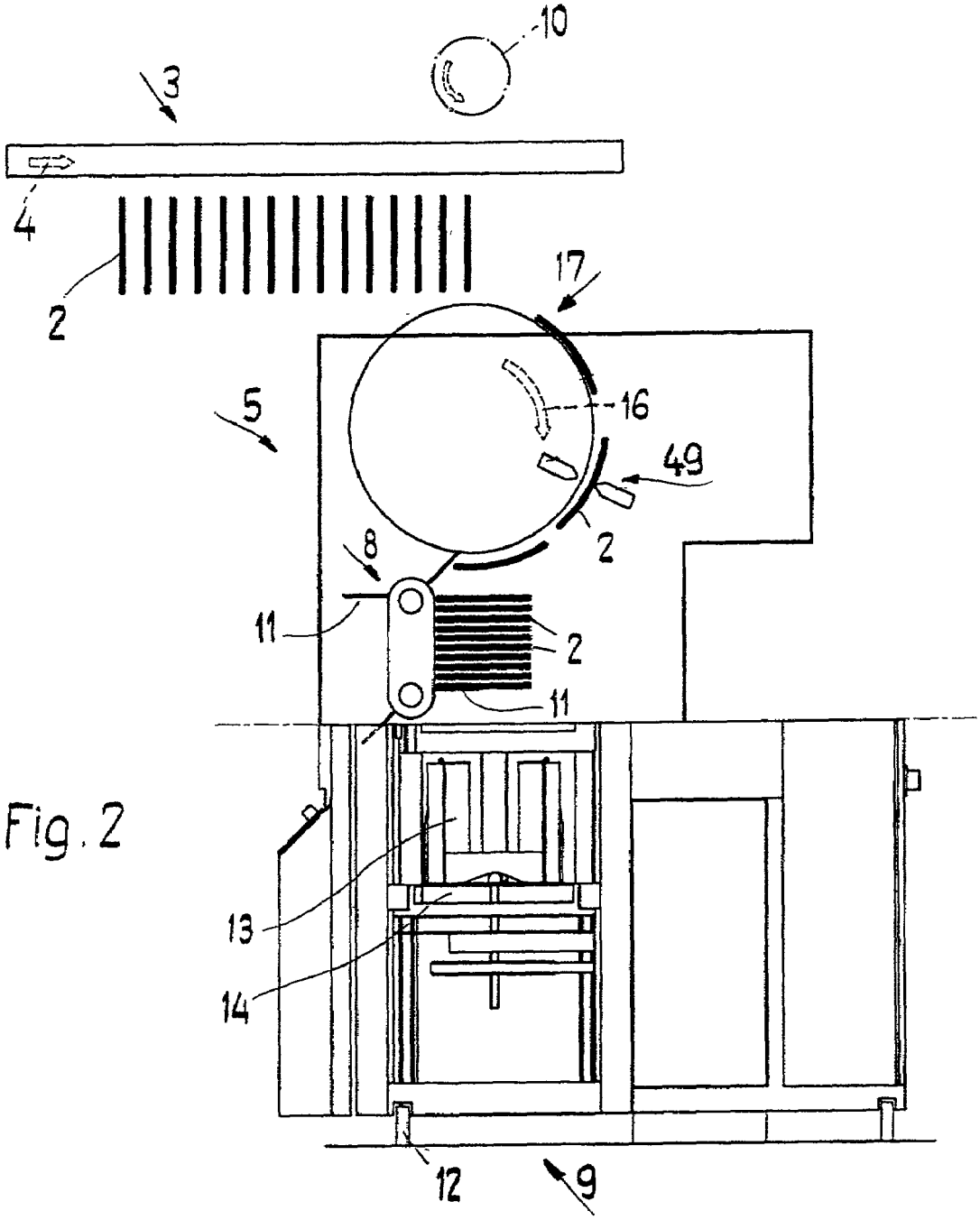
FIG. 2 shows one embodiment of the invention for processing printed products removed from a printed product processing machine (insertion machine)

FIG. 2 shows schematically the device 1 according to the invention wherein the printed products 2, removed from a printed product processing machine, for example, an insertion machine (not shown), are supplied by means of the cycled transport device 3 according to arrow 4 to a transfer device 5. The printed products 2 are freely suspended from clamps (not illustrated) of the transport device 3 and are gripped by the transfer device 5 on the folded edge. Above the transport device 3 a removal device 10 is shown for removal of printed products 2.

Figure 3:
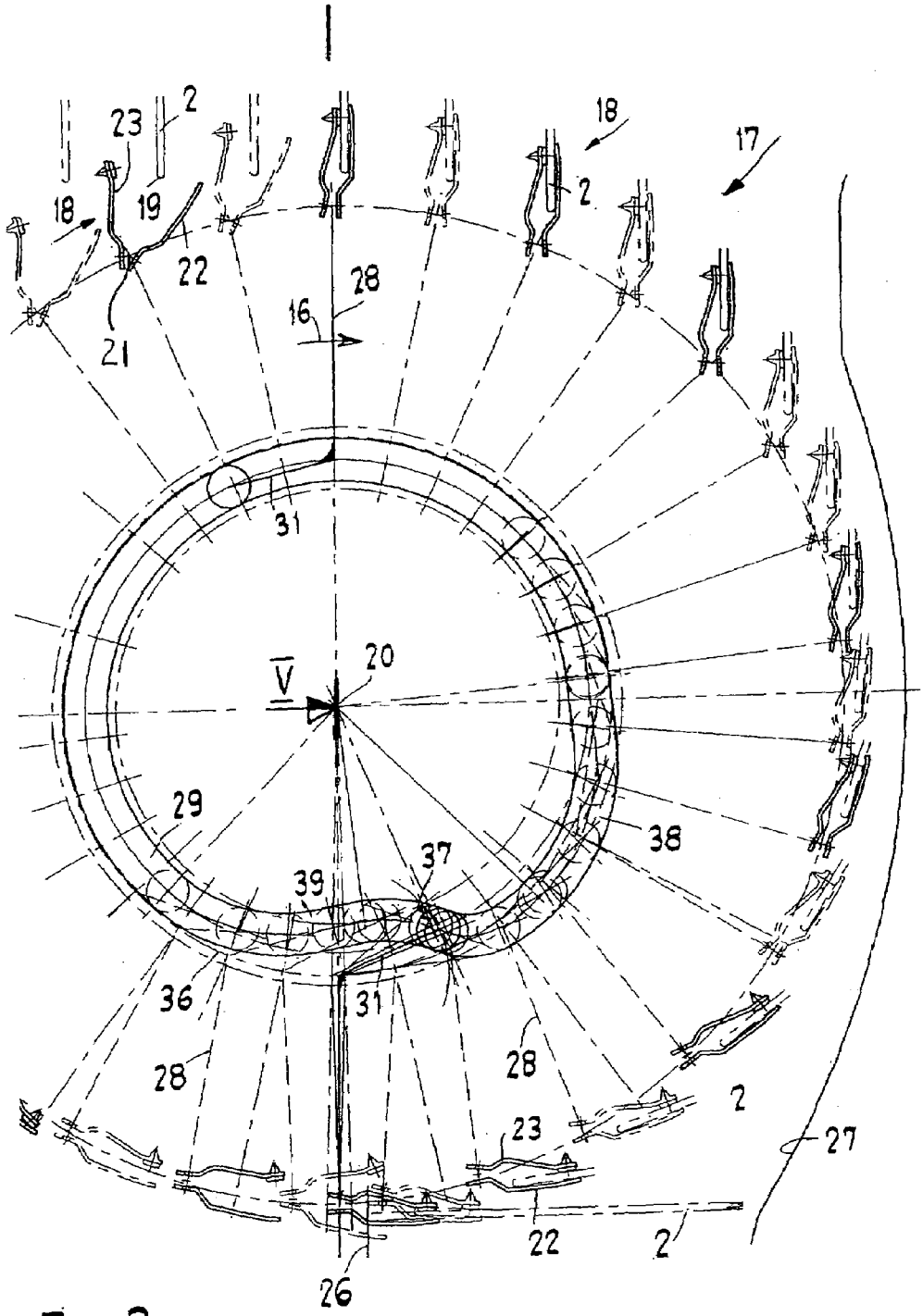
FIG. 3 is a side view of a transport device of the device according to the invention.

In comparison to the embodiment of FIG. 1, the printed products 2 which are transported in a suspended arrangement are engaged by a conveying drum 17 revolving in the direction of arrow 16. The drum 17 has grippers 18 on its circumference which are spaced at a spacing corresponding to that of the printed products 2 suspended with the folded edge positioned at the lower end from the transport device. Its embodiment and function are described in detail in connection with FIGS. 3 to 5. After being gripped, the printed products 2 are turned on the transfer path to a partial stacking device 8, arranged below the conveying drum 17 and upstream of the stacking device 9, from a vertical into a horizontal position and placed onto the partial stacking device 8. As in the embodiment according to FIG. 1, the printed products 2 are collected on shelves 11 or rakes of the partial stacking device 8 formed as a transport device and during pivoting after lowering of the shelves 11 are moved into the drop shaft 13 or stacking shaft of the stacking device 9 where they are stacked on a stacking table 14 to a certain number on top one another and are then pushed out as a stack. The stacking device 9, which is formed as a stacker, is again configured on a moveable frame provided with wheels 12 so that it can thus be used in a device 1 as illustrated in FIG. 1. The conveying drum 17, forming part of the transfer device 5 and revolving in the direction of arrow 16, has on its circumference grippers 18 which grip the suspended folding edge 19 of the printed products 2 which are advanced approximately tangentially by means of the clamps of the transport device. The grippers 18 are configured to be pivotable about an axis of rotation 21 which is parallel to the axis 20 of the conveying drum 17 and can pivot on the path to the transfer station for loading the partial stacking device 8 by 90° counter to the rotational direction of the conveying drum 17 so that the printed products 2 are in a delayed conveying position before transfer.

Before the grippers 18 enter the approach area or gripping area of the transport device, they are opened by actuating the gripper arms 22, 23 by means of the controlled control levers 24, 25 (see FIGS. 4 and 5) so that the entrained printed products 2 can be immersed in the intermediate space. Approximately upon reaching the closest approach, the grippers 18 are closed and the clamps on the transport device are opened for releasing the printed products 2. By a continuous return pivot movement of the gripper 18, the printed products 2 approach the conveying drum 17 until they reach the transfer area opposite the receiving or gripping area. The transfer area is positioned above the above described partial stacking device 8 and ends at the stripper plate 26 which transversely penetrates the circulation path of the printed products 2. As shown in FIG. 2, the printed products 2 can be labeled on their way to this location by an inkjet device 49. The printed products 2 guided by the grippers 18 to the stripper plate 26 are released in a timely fashion from the grippers 18 so that a damaging impact is prevented and the printed products 2, guided by the stripper plate 26 and a laterally spaced guiding member 27, can be gently placed onto the shelf 11 of the partial stacking device 8. For assisting this feature, the grippers 18 in the transfer area of the printed products 2 are controlled by a control device to carry out a frozen or paused movement or a movement greatly slowing the circulating speed of the grippers 18. In addition, in the transfer area the grippers 18 are opened.

Figure 4:
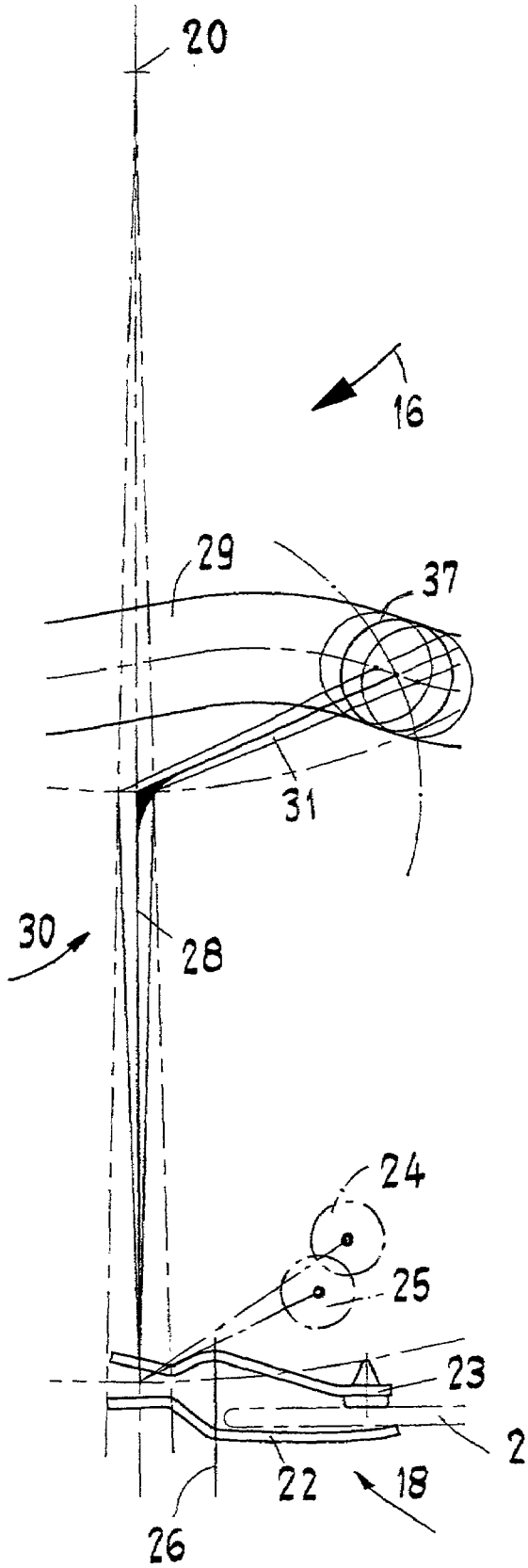
FIG. 4 shows a detail illustration of a controlled gripper.
Figure 5:
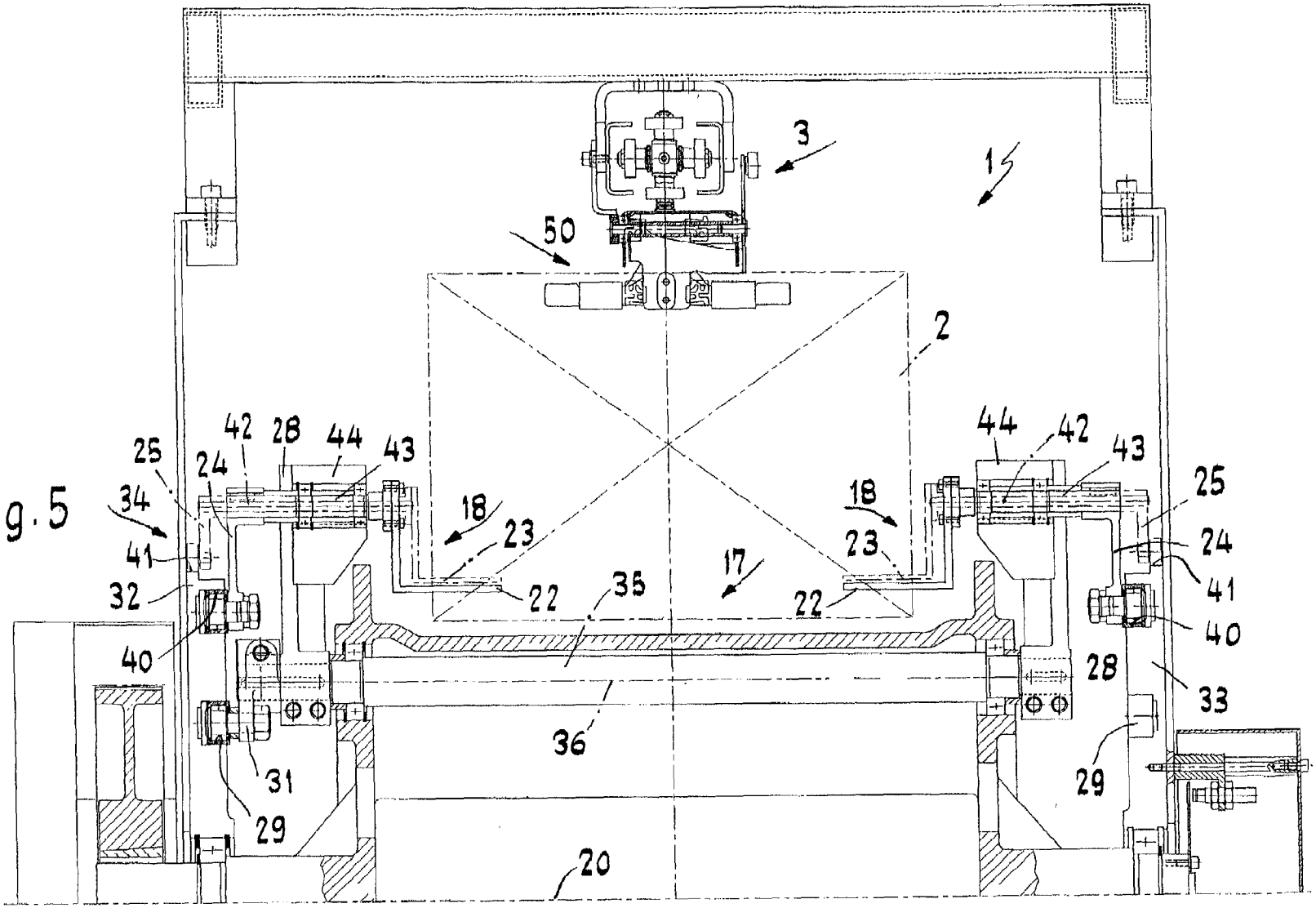
FIG. 5 is a cross-section of the transport device according to line V–V in FIG. 3.

For delaying the circulating speed of the grippers 18 in the transfer area or already shortly before, the grippers 18 are fastened on a pivotably controlled lever arm 28 of a double lever 30 connected to a stationary control path 29 (see also FIGS. 4 and 5). In the illustrated embodiment a double lever 30 is provided whose lever arm 28 in the transfer area of the printed products 2 is approximately radially aligned and which at the start of the transfer area or in front of it is moved from a forwardly shifted position into a rearwardly shifted counter movement which increasingly delays the circulating speed of the grippers 18. In order for the printed products 2 to achieve a more stable position on their own way to the transfer area, the guide member 27 extends at a spacing to the movement path of the printed products 2 from the conveying drum 17 upwardly. The control of the lever arm 28 is realized by a control arm 31 which is connected therewith and which engages the control path 29. The control path 29 is arranged on an lateral shield 32, 33 of a machine frame 34 supporting the conveying drum 17. According to the illustrated embodiment, two grippers 18 are correlated with one printed product 2 and the two lever arms 28 of these grippers are connected to one another by a control shaft 35, i.e., each control shaft 35 has correlated therewith a control arm 31, wherein same can be alternatingly connected with the control path 29 of one or the other lateral shield 32, 33 in a control-effective way. However, one control path 29 for actuating the control arms 31 is sufficient. The control shafts 35 of the double levers 30 are pivotably supported at a uniform spacing on a graduated circle 36 concentrically arranged to the axis of rotation 37 of the conveying drum 17 and located within the circumference of the conveying drum 17.

The control path 29 of the control arms 31, which engage by means of a roller 37 the control path 29, extends, before the printed products 2 reach the transfer area, on a curve section 38 which deviates outwardly from a circular arc by which the grippers 18 on the lever arms 28 are shifted forwardly on the circulating path so that in the transfer area, where the grippers 18 are shifted rearwardly as a result of an inwardly extending control section 39, a longer delay results which prevents a severe impact of the printed products 2 on the stripper plate 26.

The actuation of the grippers 18 pivotably fastened on the lever arm 28 of the double lever 30 is realized by a control lever 24, 25 correlated with a gripper arm 22, 23, respectively. They are connected in a control-effective way with control curves 40, 41 provided on the lateral shield 32, 33 of the machine frame 34. The gripper arms 22, 23 are connected to a gripper arm shaft 42 or with a gripper arm hollow shaft 43, in which the gripper arm shaft 42 is pivotably arranged and which is supported in the support 44 of the lever arm 28. The illustration of the gripper arms 22, 23 in FIG. 5 does not correspond to the functional position and serves only for simplifying the explanation of the device. For the control lever 25 an open control curve 41 was selected which makes it possible to transfer the gripper 18 or a gripper pair, provided on opposite sides of the conveying drum 17, into an inoperative position by means of a mechanical parking device acting on the control lever 25, for example, in the case of a partial removal of the printed products 2 from the transport device 3.

The circulating paths of the grippers 18 fastened on the conveying drum 5 are distributed on both sides relative to the transport device 3.

While specific embodiments of the invention have been shown and described in detail to illustrate the inventive principles, it will be understood that the invention may be embodied otherwise without departing from such principles.

What is claimed is:

1. A device for processing printed products supplied to a stacking device, wherein the printed products are picked up at a delivery of a printing machine or a printed product processing machine by a transport device and are transported in a suspended position on a transport path to a transfer device upstream of a stacking device, wherein the stacking device is a unit detachable from the transfer device and selectively connectable to the transfer device which is connected so as to effect conveying of the printed products to the printing machine or the printed product processing machine, wherein the transfer device has a transfer path and is formed as a partial stacking device at the end of the transfer path, wherein the partial stacking device is synchronized to a working cycle of the stacking device, the transfer device having a conveying drum, wherein the conveying drum at the upstream end of the transfer path, where the printed products approach the transfer device in an approach area, is driven in rotation in the same direction and synchronously to the printed products, wherein the conveying drum has pivotable grippers arranged circumferentially on the conveying drum, wherein the grippers are configured to grip downwardly extending ends of the printed products and, at the end of the transfer path, to position the printed products on the partial stacking device in an approximately horizontal position by opening the grippers.

2. The processing device according to claim 1, wherein the grippers have at least one movable gripper arm which, in the approach area of the suspended printed products, is controllable for moving into a closed position for securing the printed products and in the transfer area at the end of the transfer path into an open position for releasing the printed products.

3. The processing device according to claim 2, wherein the transfer path ending in the transfer area extends about an angle of approximately 180°.

4. The processing device according to claim 2, further comprising a control device configured to control the grippers in the transfer area of the printed products so as to perform a frozen or paused movement or a movement delaying the circulating speed of the printed products.

5. The processing device according to claim 4, wherein the control device comprises double levers having a pivotably controlled lever arm connected to the grippers, respectively, and wherein the double levers are connected to a control path of the control device.

6. The processing device according to claim 5, wherein the double levers comprise an angled control arm engaging the control path, wherein the lever arms, at least in the gripping area of the grippers, are aligned approximately radially to the axis of a rotation of the conveying drum and are connected to the angled control arm actuated by the control path.

7. The processing device according to claim 6, wherein the double levers are pivotably supported at a uniform spacing on a graduated circle concentrically arranged to the axis of rotation of the conveying drum.

8. The processing device according to claim 7, wherein the control path has an angular range correlated with the transfer area of the printed products, wherein the angular range forms a control section continuously approaching the axis of rotation of the conveying drum.

9. The processing device according to claim 1, wherein the partial stacking device has a stripper plate penetrating the circulating path of the printed products approximately at the end of the transfer area.

10. The processing device according to claim 5, wherein the control device further comprises control levers engaging control curves, wherein the gripper arm of the grippers is arranged on the lever arm of the double levers, and wherein the control levers pivotably control the gripper arm of the grippers, respectively.

11. The processing device according to claim 2, wherein at least one of the gripper arms of the grippers is movable into an inoperative position or into a position allowing for partial removal of the printed products.

12. The processing device according to claim 1, wherein the grippers form gripper pairs and wherein the grippers of the gripper pairs are fastened oppositely on the lateral ends of the conveying drum, respectively.

13. The processing device according to claim 12, wherein the circulating paths of the grippers are distributed on both sides of the transport device.

* * * * *